US006316175B1

(12) United States Patent
Van den Zegel et al.

(10) Patent No.: US 6,316,175 B1
(45) Date of Patent: Nov. 13, 2001

(54) LIGHT-SENSITIVE SILVER HALIDE RADIOGRAPHIC FILM MATERIAL HAVING SATISFACTORY ANTISTATIC PROPERTIES DURING HANDLING

(75) Inventors: Marc Van den Zegel, Boortmeerbeek; Etienne Van Thillo, Essen; Bavo Muys, Eppegem, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/507,745

(22) Filed: Feb. 22, 2000

Related U.S. Application Data

(60) Provisional application No. 60/127,150, filed on Mar. 31, 1999.

(30) Foreign Application Priority Data

Feb. 22, 1999 (EP) ..... 99200496

(51) Int. Cl.[7] ..... G03C 1/85; G03C 1/89; G03C 5/16

(52) U.S. Cl. ..... 430/502; 430/527; 430/528; 430/529; 430/530; 430/967

(58) Field of Search ..... 430/527, 528, 430/529, 530, 502, 967, 428, 432

(56) References Cited

U.S. PATENT DOCUMENTS 5,362,613 * 11/1994 Shiratsuchi et al. ..... 430/527
5,376,517 * 12/1994 Kurachi et al. ..... 430/527
5,391,472 * 2/1995 Muys et al. ..... 430/527
5,506,050 * 4/1996 Kurachi et al. ..... 430/527
5,604,083 * 2/1997 Valsecchi et al. ..... 430/528
5,910,385 * 6/1999 Gardner et al. ..... 430/527
5,955,250 * 9/1999 Christian et al. ..... 430/527
5,981,126 * 11/1999 Majumdar et al. ..... 430/527

FOREIGN PATENT DOCUMENTS 0 602 713 A1 6/1994 (EP) .
0 813 110 A1 12/1997 (EP) .
0 890 874 A1 1/1999 (EP) .

* cited by examiner

*Primary Examiner*—Richard L. Schilling
(74) *Attorney, Agent, or Firm*—Breiner & Breiner, L.L.C.

(57) ABSTRACT

A silver halide photographic material has been provided, having in a layer arrangement at one or both sides of a subbed support, corresponding with a single-side coated or a double-side coated material respectively, one or more layer(s) comprising a light-sensitive silver halide emulsion, one or more protective antistress layer(s) and, optionally, an outermost afterlayer, wherein at least one of said layers, subbing layer(s) inclusive, further comprises means in order to provide, when conditioned at a relative humidity of at most 30%, an electrical resistance, measured as described in Research Disclosure June 1992, item 33840, of from $4\times10^9$ Ω/sq. up to $5\times10^{10}$ Ω/sq. for the layer having the lowest resistance.

6 Claims, 1 Drawing Sheet

LIGHT-SENSITIVE SILVER HALIDE RADIOGRAPHIC FILM MATERIAL HAVING SATISFACTORY ANTISTATIC PROPERTIES DURING HANDLING

Benefit is claimed under 35 USC 119(e) based on provisional application Serial No. 60/127,150 filed Mar. 31, 1999.

FIELD OF THE INVENTION

The present invention relates to a radiographic light-sensitive silver halide film material having improved antistatic properties.

BACKGROUND OF THE INVENTION

It is known that hydrophobic resin sheet and web materials of low conductivity readily become electrostatically charged by frictional contact with other elements during their manufacture, e.g. during coating or cutting, and during use, e.g. during the recording of information in exposure devices. Since radiographic film materials, those used for medical diagnostic purposes as well as those used for non-destructive testing methods, have a hydrophobic resin as a support it is no wonder that transport problems tend to occur in the exposure devices as well as in the processors wherein after loading the film into the processor the film runs into a developer station, a fixer station, optionally rinsing stations inbetween and always after said fixer station, followed by drying.

In order to prevent such web materials from being electrostatically charged the "tribo-electrical behaviour" of the said web material has been optimized (e.g. versus polymethylmethacrylate as a reference polymer) in that differences with respect to the said tribo-electrical behaviour between said web material and materials with which contact is made during further handling (especially before, during and after exposure and before processing) are minimized. Useful compounds added to the layers coated onto the resin sheet or web material are e.g. polyoxyethylene compounds, whether or not combined with surfactants having fluoride substituents as has e.g. been described in EP-A's 0 191 491, 0 245 090, 0 260 593, 0 319 951, 0 320 962, 0 370 404, 0 534 006, 0 633 496 and 0 644 454, and in U.S. Pat. Nos. 4,229,524; 4,367,283; 4,388,402; 4,582,781; 4,649,102; 4,916,054; 5,098,821; 5,258,276 and 5,561,032.

Such combination of antistatic agents may provide a so-called "lateral electrical surface resistivity" of about $10^{12}$ Ω/square, measured at a relative humidity of 30%. The said materials are said to provide "non-permanent antistatic properties" due to their "ionic conductivity". More recently "permanent antistatic properties" have been attained for materials by provision of "electronic conductivity", thereby reducing the said "lateral electrical resistance" to a value of about $10^6$ Ω/square. Such a relatively low resistance has been obtained, particularly in the presence of electronically conducting polymers as e.g. polyethylene dioxythiophene, described in EP-A's 0 253 594,0 292 905, 0 339 340, 0 348 961, 0 440 957, 0 505 955, 0 530 849,0 553 502, 0 554 588, 0 564 911, 0 570 795, 0 593 111, 0 602 713 and 0 628 560, and in U.S. Pat. Nos. 5,279,768; 5,213,714 and 5,306,443.

In most cases the thiophene compounds are comprised in one or more subbing layers of the materials. By reducing the lateral electrical resistance of the light-sensitive silver halide photographic material the positive or negative charges generated after e.g. friction with another material (e.g. inlet in a processing machine) are non-locally distributed over the whole material making decrease the charge density, whereby local concentrations of electrostatic charges are avoided. Moreover it is possible that electrical charges may flow back after interrupting contact with electrically conducting materials. It is clear that such low electrical surface resistivity is highly appreciated.

The said "antistatic layers" may be subbing layers, providing adhesion between the web sheet and the other layers to be coated thereon, wherein said subbing layers are normally coated at both sides of the said web sheet or support. The materials having light-sensitive silver halide emulsion layers at one or both sides of the subbed supports are said to be "single-side" or "double -side" coated respectively.

In case of a single-side coated material the compounds providing antistatic properties may be added to the backing layer(s). Other layers containing antistatic agents and coated onto the subbing layers may be an intermediate gelatinous layer, whether or not containing filter dyes in favour of sharpness, one or more emulsion layers coated adjacent to each other, one or more protective antistress layers and, optionally, an afterlayer. "Handling film materials" should be understood as "loading cassettes" with e.g. radiological films in intensifying screen/film sytems as well as recording films in laser devices for recording digitally stored information on a hard-copy material, which may cause electrostatic phenomena such as "electrostatic sticking" to occur, as well as electrostatic charging or discharging.

Effects of handling caused by electrostatical phenomena can be visually observed on the images obtained after processing of e.g. radiographic film materials which have been run in some processing devices: it has been established that undesired "sparks" are occurring in form of a black line, thereby disturbing the diagnostic value of the image, even when the electrical surface resistance is as low as $10^6$ Ω/sq., especially at low relative humidity of about 30%. This is the case with e.g. the trademarked radiographic materials Curix Ortho HTG and Curix Ortho HTL from Agfa-Gevaert N.V., Mortsel, Belgium. It is believed that those spark discharges, are generated by charge transport from electrostatic charges with which an operator is loaded, who brings an unprocessed film material to a processing machine that is connected to the ground: charges are conducted from the operator, through the film after making contact with metal surfaces making part of the said processing machine and further to the ground. The same phenomena may appear in an apparatus wherein metallic parts have been mounted so that they are isolated from the rest of the apparatus and when said metallic parts bear accumulated charges: a discharge may take place through the film, over the operator and further to the earth. As a result "strikes" or "sparks" in form of black lines are found on the film after processing whereby the diagnostic value of the film is highly disturbed.

OBJECTS OF THE INVENTION

It is an object of the present invention to provide a light-sensitive silver halide photographic material for diagnostic imaging in medical as well as in non-destructive testing applications, wherein said film has such antistatic properties that spark discharges are avoided, in particular when loading said film material into a processing machine.

It is a further object of the present invention to provide a method of formation of a diagnostic image by means of the said materials.

Further advantages and embodiments of the present invention will become apparent from the following description.

SUMMARY OF THE INVENTION

The objects of the present invention are realized by providing a silver halide photographic material comprising at one or both sides of a subbed support, corresponding with a single-side coated or a double-side coated material respectively, one or more layer(s) comprising a light-sensitive silver halide emulsion, one or more protective antistress layer(s) and, optionally, an outermost afterlayer, wherein at least one of said layers, subbing layer(s) inclusive, further comprises means in order to provide, when conditioned at a relative humidity of at most 30%, an electrical resistance, measured as described in Research Disclosure June 1992, item 33840, of from $4\times10^9$ Ω/sq. up to $5\times10^{10}$ Ω/sq. for the layer having the lowest resistance, more preferably from $1\times10^{10}$ Ω/sq. up to $5\times10^{10}$ Ω/sq. and still more preferably up to $2\times10^{10}$ Ω/sq., even at a relative humidity of 30% or lower, thanks to the presence of a conductive compound, preferably a polythiophene derivative, and most preferably polyethylene dioxythiophene (PEDT).

This compound is preferably incorporated in the antistatic layer coated upon the subbing layer, making part of the subbing layer unit, wherein said subbing layer unit is in direct contact with the support and wherein said polyethylene dioxythiophene in the said antistatic layer is present as an aqueous dispersion containing a polymeric anion, more preferably polystyrene sulphonate.

An image forming method for the formation of a radiographic diagnostic image has further been provided, said method comprising the step of exposing image-wise by laser irradiation or by X-ray irradiation said materials, followed by processing by the steps of developing, fixing, rinsing and drying.

Figure 1:
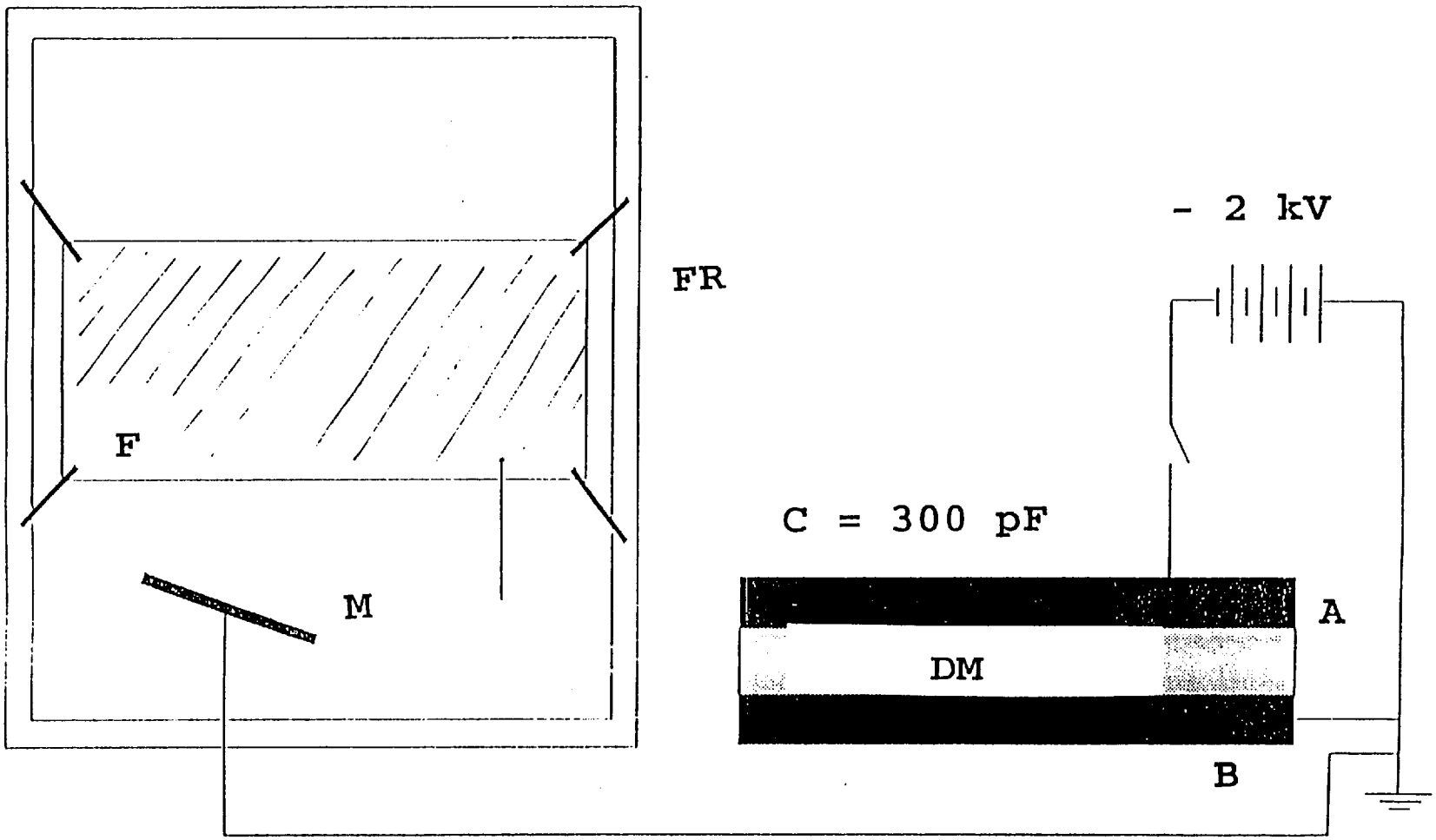
FIG. 1 shows the simulation apparatus by which the appearance of "line-discharges" (detected afterwards after processing in a processing machine) was examined. The procedure has extensively been explained in the Examples.

An isolated and loaded operator causing electrostatic discharge (occurring as "line discharges" on the film material after processing) is represented by a loaded capacitor plate having a capacity C=300 pF. Contact has been made between plate A of said capacitor (loaded up to a capacity of 300 pF) and a film material sample F without making contact with any other subject (by hanging up the film material sample F in an isolating frame FR). The other capacitor plate B, without making contact with the earth, was loaded up to −2 kV (corresponding with a discharge energy of about 2.4 mJoule). After having no charging current anymore, contact with the source of high voltage has been broken. In capactor C between plates A and B dielectric medium DM is present.

In order to simulate the metal inlet of a processing machine a metal bar M having a relatively sharp edge (representing the inlet of the earthed processing machine) has been provided in order to make contact with the (thereby discharged) film material F.

DETAILED DESCRIPTION OF THE INVENTION

It has been found unexpectedly that, in order to avoid a failure in form of a black line hindering an unambiguous diagnosis from a processed recording film material after processing said material in certain film processors, that it is of utmost importance that the layer in the layer arrangement of said film material having the lowest resistance (or the highest conductivity) is characterized by a resistance, even at a relative humidity of 30% or lower, having a value of from $4\times10^9$ Ω/sq. up to $5\times10^{10}$ Ω/sq. for the layer having the lowest resistance, when measured according to the method described in Research Disclosure June 1992, item 33840. More preferably this resistance should have a value of from $1\times10^{10}$ Ω/sq. up to $5\times10^{10}$ Ω/sq. and even more preferably up to $2\times10^{10}$ Ω/sq. Values of the said resistance outside these barriers, thus lower than $4\times10^9$ Ω/sq. or higher than $5\times10^{10}$ Ω/sq., give rise to the problems of spark discharges as set forth hereinbefore.

As explained above, in a preferred embodiment at least one of the antistatic layers being a light-sensitive silver halide emulsion, a protective antistress layer and/or an—optionally present—after-layer contain(s) a conductive compound the nature of which will now be explained in detail.

Such a compound can show ionic or electronic conductivity. Ionic conducting compounds are e.g. high molecular weight polymeric compounds having ionic groups, e.g. carboxylic sodium salt groups, built in at frequent intervals in the polymer chain [ref. Photographic Emulsion Chemistry, by G. F. Duffin,—The Focal Press—London and New York (1966)—Focal Press Ltd., p. 168]. In order to further enhance the permanence of the conductivity of ionic conductive polymers it has been proposed to cross-link these polymers with hydrophobic polymers as has been illustrated in U.S. Pat. Nos. 4,585,730; 4,701,403; 4,589,570; 5,045,441 and in EP-A's 0 391 402 and 0 420 226. The conductivity however of an antistatic layer containing said ionic conductive polymers, even after cross-linking, is dependent on moisture, quantitatively expressed as the relative humidity.

Therefore electronically-conducting conjugated polymers have been developed that have electronic conductivity. Representatives of such polymers have been described in the periodical Materials & Design, Vol. 11, No. 3—June 1990, p. 142–152, and in the book "Science and Applications of Conducting Polymers"—Papers from the 6th European Physical Society Industrial Workshop held in Lothus, Norway, 28–31 May 1990, Edited by W R Salaneck Linkoping University, D T Clark ICI Wilton Materials Research Centre, and E J Samuelson University of Trondheim, published under the Adam Hilger imprint by IOP Publishing Ltd Techno House, Redcliffe Way, Bristol BS1 6NX, England. Substances having electronic conductivity instead of ionic conductivity have a conductivity that is independent from moisture. The said substances, being conductive compounds, are particularly suited for use in the production of antistatic layers with permanent and, especially preferred as in the present invention, reproducibly controlled conductivity.

According to the present invention said conductive compound is a (co)polymer compound selected from the group consisting of a polymer with acidic groups optionally further crosslinked by aziridines; a mixture of water-soluble conductive polymers, containing sulphonic acid groups, sulphuric acid groups or carboxylic acid groups together with a hydrophobic polymer and a crosslinking or curing agent, a (poly)phosphazene, a graft polymer of polyphosphazenes with polyalkylene glycols; (co)polymers of a diallyldialkylammonium salt; polyalkyleneimine grafted vinyl polymers; a copolymer of styrene sulphonic acid and a hydroxyl group containing monomer crosslinked by methoxyalkylmelamine; the said copolymer of styrene sulphonic acid but crosslinked by a hydrolyzed metal lower alkoxide; polymer complexes containing polyalkylene oxide units; a combination of polymerized oxyalkylene oxide units and a fluorine containing inorganic salt; a polyoxyalkylene in combination with a thiocyanate, iodide, perchlorate, or periodate; a highly crosslinked vinylbenzyl quaternary ammonium polymer in combination with a hydrophobic binder; a sulphonated anionic microgel latex, polymers and copolymers of pyrrole, furan, aniline, vinylcarbazole and pyridine and their derivatives, tetracyanoquinone (TCNQ) complex and polyarenemethylidenes and derivatives thereof.

Many of the known electronically conductive polymers among them are highly colored which makes them less suited for use in photographic materials of to the present invention, but some of them of the group of the polyarenemethylidenes, as e.g. polythiophenes and polyisothianaphthenes are not prohibitively colored and transparent, at least when coated in thin layers. As a result thereof polythiophene derivatives are a preferred type of conductive compounds for use in the materials of the present invention.

The production of conductive polythiophenes has been described in preparation literature mentioned in the above mentioned book "Science and Applications of Conducting Polymers", p. 92.

For ecological reasons the coating of antistatic layers should proceed, where possible, from aqueous solutions by using organic solvents in amounts as low as possible. The production of antistatic coatings from aqueous coating compositions being dispersions of polythiophenes in the presence of polyanions has described in EP-A 0 440 957. Thanks to the presence of the polyanion the polythiophene compound is kept in dispersion.

Preferably said polythiophene has thiophene nuclei substituted with at least one alkoxy group, or —$O(CH_2CH_2O)_nCH_3$ group, n being an integer having a value from 1 to 4, or, most preferably, thiophene nuclei that are ring closed over two oxygen atoms with an alkylene group including such group in substituted form.

Preferred polythiophenes for use in materials according to the present invention are made up of structural units corresponding to the following general formula (I):

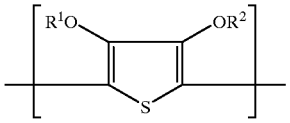

in which each of $R^1$ and $R^2$ independently represents hydrogen or a $C_{1-4}$ alkyl group or together represent an optionally substituted $C_{1-4}$ alkylene group or a cycloalkylene group, preferably an ethylene group, an optionally alkyl-substituted methylene group, an optionally $C_{1-12}$ alkyl- or phenyl-substituted 1,2-ethylene group, a 1,3-propylene group or a 1,2-cyclohexylene group.

The most preferred compound however is poly(3,4-ethylenedioxythiophene), (PEDT) with following formula (II):

(II)

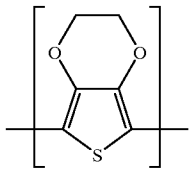

The preparation of said polythiophene and of aqueous polythiophenepolymeric polyanion dispersions containing said polythiophene has been described EP-A 0 440 957, cited above. The synthesis proceeds, in the presence of said polymeric polyanion compounds, by oxidative polymerization of 3,4-dialkoxythiophenes or 3,4-alkylenedioxythiophenes according to the following general formula (III) :

(III)

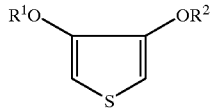

wherein:

$R^1$ and $R^2$ are as defined in general formula (I), with oxidizing agents typically used for the oxidative polymerization of pyrrole and/or with oxygen or air in the presence of said polyacids, preferably in aqueous medium containing optionally a certain amount of organic solvents, at temperatures of 0 to 100° C.

The polythiophenes get positive charges by the oxidative polymerization. The location and number of said charges cannot be determined with certainty and therefore they are not mentioned in the general formula of the repeating units of the polythiophene polymer.

The size of polymer particles in the coating dispersion is in the range of from 5 nm to 1 $\mu$m, preferably in the range of 40 to 400 nm.

Suitable polymeric polyanion compounds required for keeping said polythiophenes in dispersion are provided by acidic polymers in free acid or neutralized form. The acidic polymers are preferably polymeric carboxylic or sulphonic acids. Examples of such polymeric acids are polymers containing repeating units selected from the group consisting of acrylic acid, methacrylic acid, maleic acid, vinyl sulfonic acid and styrene sulfonic acid or mixtures thereof.

The anionic acidic polymers used in conjunction with the dispersed polythiophene polymer have preferably a content of anionic groups of more than 2% by weight with respect to said polymer compounds to ensure sufficient stability of the dispersion. Suitable acidic polymers or corresponding salts have been described e.g. in DE-A's 25 41 230, 25 41 274 and 28 35 856, in EP-A's 0 014 921 0 069 671 and 0 130 115, and in U.S. Pat. Nos. 4,147,550; 4,388,403 and 5,006,451.

The polymeric polyanion compounds may consist of straight-chain, branched chain or crosslinked polymers. Cross-linked polymeric polyanion compounds with a high amount of acidic groups are swellable in water and are named microgels. Such microgels have been disclosed e.g. in U.S. Pat. Nos. 4,301,240, 4,677,050 and 4,147,550.

The molecular weight of the polymeric polyanion compounds being polyacids is preferably in the range from 1,000 to 2,000,000 and more preferably in the range from 2,000 to 500,000. Polyacids within the above criteria are commercially available, for example polystyrene sulfonic acids and polyacrylic acids, or may be produced by known methods (ref. e.g. Houben-Weyl, Methoden der Organischen Chemie, Vol. E20, Makromolekulare Stoffe, Teil 2, (1987), pp. 141 et seq.).

Instead of the free polymeric polyacids applied in conjunction with the polythiophenes it is possible to use mixtures of alkali salts of said polyacids and non-neutralized polyacids, optionally in the presence of monoacids. Free acid groups of the polyanionic polymer may be allowed to react with an inorganic base, as with sodium hydroxide, in order to obtain a neutral polymer dispersion before coating.

The weight ratio of polythiophene polymer to polymeric polyanion compound(s) can vary widely, for example from about 50/50 to 15/85. The most preferred polymeric polyanion for use in combination with the polythiophene derivative used in materials according to the present invention, e.g. PEDT, is polystyrene sulphonate (PSS).

Besides the first embodiment described hereinbefore wherein the conductive compound is a polythiophene derivative in another embodiment a conductive compound providing the desired resistance when measured by the method described in Research Disclosure June 1992, item 33840, is a metal oxide compound, said metal being selected from the group consisting of tin, indium tin, vanadium, zinc, manganese, titan, indium, silicium, magnesium, barium, molybdene and tungsten. Said metal oxides, such as vanadium pentoxide, as disclosed e.g. in WO 91/02289, U.S. Pat. No. 5,221,598; ZnO, $SnO_2$, MgO, as disclosed in e.g. U.S. Pat. No. 5,238,801, colloidal manganese dioxide as disclosed in EP-A 0 504 826; oxides from Zn, Ti, In, Si, Mg, Ba, Mo, W, V, as disclosed in EP-A 0 569 821; in combination with a fluorine containing (co)polymer according to EP-A 0 552 617, a reaction product of a metal oxide sol and a chitosan salt as in EP-A 0 531 006; heteropolycondensates of tin and boron oxide as described in WO 90/013851; doped metal oxides; silica and modified silica compounds, as in U.S. Pat. Nos. 4,895,792; 5,385,986 and 5,236,818; EP-A's 0 334 400, EP-A 0 438 621, EP-A 0 296 656 and EP-A 0 444 326, conductive polymers with acidic groups optionally further crosslinked e.g. by aziridines or other compounds, such as those disclosed in U.S. Pat. Nos. 4,960,687; 4,891,308; 5,077,185 and 5,128,233; in EP-A's 0 318 909, 0 439 181, 0 486 982 and 0 505 626 and in DE-A 41 03 437; mixtures of a water-soluble conductive polymer, containing e.g. sulphonic acid groups, sulphuric acid groups or carboxylic acid groups and in addition thereto a hydrophobic polymer and a crosslinking or curing agent as disclosed e.g. in U.S. Pat. Nos. 5,013,637; 5,079,136; 5,098,822; 5,135,843 and EP-A's 0 432 654, 0 409 665 and 0 391 402; (poly)phosphazene derivatives, as described in U.S. Pat. Nos. 4,948,720 and 4,898,808 and in WO 90/08978; graft polymers of polyphosphazenes with polyalkylene glycols as disclosed in EP-A 0 304 296; (co)polymers of a diallyldialkylammonium salt as disclosed in EP-A 0 320 692, polyalkyleneimine grafted vinyl polymers such as disclosed in U.S. Pat. No. 5,153,115, copolymer of styrene sulphonic acid and a hydroxyl group containing monomer crosslinked by methoxyalkylmelamine as described in WO 91/18061, the same copolymer but crosslinked by a hydrolyzed metal lower alkoxide as disclosed in WO 91/18062; polymer complexes containing polyalkylene oxide units as disclosed in JP-A 62/286038; a combination of polymerized oxyalkylene oxide units and a fluorine containing inorganic salt as disclosed in EP-A 0 170 529; a polyoxyalkylene in combination with a thiocyanate, iodide, perchlorate, or periodate as in U.S. Pat. No. 4,272,616; a highly crosslinked vinylbenzyl quaternary ammonium polymer in combination with a hydrophobic binder as described in *Research Disclosure*, June 1977, Item 15840 and U.S. Pat. No. 3,958,995; sulphonated anionic microgel latices as described in *Research Disclosure*, October 1977, Item 16258; polymers and copolymers of pyrrole, furan, aniline, vinylcarbazole, pyridine, and other heterocycles and their derivatives as disclosed in several patents, usually outside the scope of imaging science, as in EP-A's 0 537 504, 0 326 864, 0 264 786, 0 259 813, 0 195 381 and 0 469 667; in DE-A's 39 40 187, 37 43 519, 37 34 749 and 37 16 284 and in WO 96/01480; and so-called TCNQ-complexes as e.g. N-butylisochinolinium-tetracyanoquinone-dimethane. References with respect to TCNQ-complexes can be found in "*Handbook of organic conductive molecules and polymers*", Vol. 1, Chapter 4, p. 229, and in *J. Am. Chem. Soc.*, Vol. 84, (162) p. 3370.

In a further embodiment of the present invention in said material said conductive compound is a mixture of different types of conductive compounds, mentioned hereinbefore.

In a more preferred embodiment in the material according to the present invention said conductive compound is thus a polythiophene compound present as an aqueous dispersion of a polythiophene compound/polymeric anion complex, incorporated in a layer or layers providing antistatic properties as in one or more optionally present afterlayers and/or in a subbing layer unit, more preferably in a layer coated upon the subbing layer in direct contact with the support.

In a still more preferred embodiment in the material according to the present invention said polymeric anion is polystyrene sulphonate and in the most preferred embodiment said polythiophene compound is polyethylene dioxythiophene (PEDT).

Apart from being rendered antistatic by the presence of a conductive compound the outermost layer(s) can be made antistatic by adding a compound or mixtures of compounds which reduce the so-called triboelectric chargeability of the layer. Usually one of these compounds is a perfluorated surfactant. The triboelectric chargeability of a layer versus a reference material is expressed as its $Q_{Far}$ value which is determined as follows. The experimental mounting consists of two concentric cylinders isolated from each other. The external cylinder is connected to the earth potential and the internal cylinder, functioning as cage of Faraday, is connected to an electrometer. The internal cylinder contains a flat metal plate to which a 275×35 mm strip of the sample to be measured is applied. A 60×35 strip of the reference material (e.g. the backing layer of CURIX HT®, trademarked product from Agfa-Gevaert N.V.) is applied to a PTFE-block (polytetrafluor-ethylene, a strong insulator) of dimensions 55×30×15 mm. Materials and test equipment are conditioned for at least 24 hours in a room with fixed temperature and relative humidity conditions. After discharging of the whole the block is put in the Faraday cage. The triboelectric charge is generated by rubbing the PTFE-block containing the reference sample under its own weight (0.53 N) over the metal plate containing the sample to be measured. The block is moved five times there and back at an average speed of 10 cm/s. Then the reference material is removed from the inner cylinder and the countercharge is measured. An average (median) of twenty repeated measurements is calculated. It was found experimentally that in order to avoid problems with static charging a $Q_{Far}$ value not surpassing $3.6\times10^{-6}$ C/m$^2$ could be allowed for an outermost layer. Materials and methods wherein a material is made antistatic by reducing its triboelectric chargeability are disclosed in e.g. U.S. Pat. Nos. 3,775,126 and 3,850,640; disclosing a combination of a cationic perfluorinated alkyl surfactant and a non-ionic alkyl phenoxy polypropylene oxide surfactant; U.S. Pat. No. 3,850,642 wherein the surface layer contains a so-called "charge control agent"; GB-A 1,330,356 wherein a fluoro-substituted quaternary ammonium compound is combined with another wetting agent; U.S. Pat. No. 4,956,270 describing the combination of an organic fluoro compound and a non-ionic surfactant; EP-A 0 288 059 disclosing particular compounds containing polyalkylene groups; EP-A 0 319 951 and U.S. Pat. No. 5,258,276 combining an anionic, a non-ionic and a fluorinated non-ionic surfactant; and EP-A 0 534 006 combining a polyalkylene compound and a fluorinated surfactant containing oxyethylene groups.

Apart from the conductive compound or the compounds reducing the triboelectric position the antistatic layers can contain several other types of ingredients. So a matting agent, also called roughening agent or spacing agent, may be present. This roughening agent can be chosen from a wide variety of chemical classes and commercial products provided the particles chosen show an excellent mechanical and thermal stability. Preferred roughening agents include following :

- the spherical polymeric beads disclosed in U.S. Pat. No. 4,861,818;
- the alkali-soluble beads of U.S. Pat. No. 4,906,560 and EP-A 0 584 407;
- the insoluble polymeric beads disclosed in EP-A 0 466 982;
- polymethylmethacrylate beads;
- copolymers of methacrylic acid with methyl- or ethylmethacrylate;
- TOSPEARL siloxane particles (e.g. types T105, T108, T103, T120), marketed by Toshiba Co;
- SEAHOSTAR polysiloxane—silica particles (e.g. type KE-P50), marketed by Nippon Shokubai Co;
- ROPAQUE particles, being polymeric hollow spherical core/sheat beads, marketed by Rohm and Haas Co, and described e.g. in U.S. Pat. Nos. 4,427,836, 4,468,498 and 4,469,825;
- ABD PULVER, marketed by BASF AG
- CHEMIPEARL, spherical poymeric particles, marketed by Misui Petrochemical Industries, Ltd.

The spacing particles must be chosen so that they are not optically disturbing.

In a most preferred embodiment the roughening agent is based on polymethyl methacrylate beads which are preferably cross-linked. They preferably have an average particle size of 0.5 to 5 $\mu$m, and most preferably 1 to 4 $\mu$m. Other preferred roughening agents are disclosed in EP-A's 0 080 225, 0 466 982, and 0 698 625. Furtheron, the antistatic layer(s) may contain an adhesion promoting agent, preferably a (co)polymer with hydrophilic groups (see example section furtheron), and a so-called anti-scratch agent, e.g. a polysiloxane-polyether copolymer.

The different other layers and sheets constituting the recording material of the present invention, apart from the antistatic layers, will be explained now in more detail. A common support of a photographic silver halide emulsion material is a hydrophobic resin support or hydrophobic resin coated paper support. Useful transparent polymeric supports include e.g. cellulose nitrate film, cellulose acetate film, polyvinylacetal film, polystyrene film, polyethylene terephthalate film, polyethylene naphthalate film, polycarbonate film, polyvinylchloride film or poly-α-olefin films such as polyethylene, polynaphthalene or polypropylene film. Hydrophobic resin supports are well known to those skilled in the art and are made e.g. of polyester, polystyrene, polyvinyl chloride, polycarbonate, preference being given to polyethylene terephthalate and polyethylene naphthalate. Hydrophobic resin supports of the materials according to the present invention are further provided with one or more subbing layers known to those skilled in the art for adhering thereto a hydrophilic colloid layer, as described e.g. for polyethylene terephthalate in U.S. Pat. Nos. 3,397,988, 3,649,336, 4,123,278 and 4,478,907, wherein in said subbing layers the conductive compound providing low lateral surface resisitivity as desired is incorporated. The thickness of such organic resin film is preferably comprised between 0.03 and 0.35 mm. In a most preferred embodiment of the present invention the support is a polyethylene terephthalate layer provided with a subbing layer. This subbing layer can be applied before or after stretching of the polyester film support. The polyester film support is preferably biaxially stretched at an elevated temperature of e.g. 70–120° C., reducing its thickness by about ½ to ⅙ or more and increasing its area 2 to 9 times. The stretching may be accomplished in two stages, transversal and longitudinal in either order or simultaneously. The subbing layer is preferably applied by aqueous coating between the longitudinal and transversal stretch, in a thickness of 0.1 to 5 $\mu$m. In case of a bismuth recording layer the subbing layer preferably contains a homopolymer or copolymer of a monomer comprising covalently bound chlorine as described in EP-A 0 464 906. Examples of said homopolymers or copolymers suitable for use in the subbing layer are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol etc.. Polymers that are water dispersable are preferred since they allow aqueous coating of subbing layers which is in favour of ecology.

Suitable coating agents for layers building-up the material according to the present invention include non-ionic agents such as saponins, alkylene oxides as e.g. polyethylene glycol, polyethylene glycol/polypropylene glycol condensation products, polyethylene glycol alkyl esters or polyethylene glycol alkylaryl esters, polyethylene glycol esters, polyethylene glycol sorbitan esters, polyalkylene glycol alkylamines or alkylamides, silicone-polyethylene oxide adducts, glycidol derivaties, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as aklylamine salts, aliphatic, aromatic, or heterocyclic quaternary ammonium salts, aliphatic or heterocyclic ring-containing phosphonium or sulphonium salts. Other suitable surfactants include perfluorinated compounds.

The silver halide photographic material according to the present invention thus preferably contains the conductive compound providing the desired resistance for the layer showing the best conductivity, wherein said silver halide photographic material comprises a subbed support and at one or both sides thereof, corresponding with a single-side coated or a double-side coated material respectively, at least one layer comprising one or more light-sensitive silver halide emulsion, a protective antistress layer and, optionally, an afterlayer, wherein at least one of said layers, subbing layer(s) inclusive, contains said conductive compound.

In the antistress layer(s) from the materials according to the present invention latex-type polymers or copolymers may be included, besides hydrophilic colloid binders, wherein those polymers or copolymers are chosen in order to be mixed homogeneously therewith. Proteinaceous colloids, e.g. gelatin, polysaccharide, and synthetic substitutes for gelatin as e.g. polyvinyl alcohol, poly-N-vinyl pyrrolidone, polyvinyl imidazole, polyvinyl pyrazole, polyacrylamide, polyacrylic acid, and derivatives thereof can be used therefore. Furthermore the use of mixtures of said hydrophilic colloids is not excluded. Among these binders the most preferred is gelatin. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No 16, page 30 (1966). In order to minimize the amount of gelatin, however can be replaced in part or integrally by synthetic polymers as cited hereinbefore or by natural or semi-synthetic polymers. Natural substitutes for gelatin are e.g. other proteins such as zein, albumin and casein, cellulose, saccharides, starch, whether or not in oxidized form, and alginates. Semi-synthetic substitutes for gelatin are modified natural products as e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, cellulose sulphates, etc.. Cross-linked copolymers may be applied, and when applied preferable amounts are at least 10% by weight versus the amount of hydrophilic colloid present in the antistress layer or layers. In addition the said copolymers may be present in an optionally present outermost gelatin free coating applied thereover.

In the material according to the present invention a preferred protective antistress layer is made from gelatin hardened up to a degree corresponding with a water absorption of less than 2.5 grams of water per $m^2$ and more preferably of at most 1 gram per $m^2$. The gelatin coverage in the protective layer is preferably not higher than about 1.20 g per sq.m and is more preferably in the range of 0.60 to 1.20 g per sq.m. Gelatin in the antistress layer may partially be replaced by colloidal silica as it gives rise to a further improvement of the obtained properties according to the present invention. Preferably colloidal silica having an average particle size not larger than 10 nm and with a surface area of at least 300 sq.m. per gram is used, the colloidal silica being present at a coverage of at least 50 mg per m2. Further the coverage of said colloidal silica in the antistress layer is preferably in the range of 50 mg to 500 mg per $m^2$. Particularly good results which are fully in accordance with the present invention are obtained by using a protective antistatic layer comprising besides the conductive compound as claimed, at least 50% by weight of colloidal silica versus the said conductive compound. Especially preferred colloidal silica particles have a surface area of 500 $m^2$ per gram and an average grain size smaller than 7 nm. Such type of silica is sold under the name KIESELSOL 500 (KIESELSOL is a registered trade name of Bayer AG, Leverkusen, Germany).

In admixture with the hardened gelatin the antistress layer may further contain friction-lowering substance(s) such as dispersed wax particles (carnaubawax or montanwax) or polyethylene particles, fluorinated polymer particles, silicon polymer particles etc. in order to further reduce the sticking tendency of the layer especially in an atmosphere of high relative humidity.

The gelatin binder can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Besides said conductive compounds providing the desired lateral electrical surface resistivity ionic or non-ionic polymers or copolymeric combinations of monomers cited hereinbefore are optionally added to non-ionic surfactants having antistatic characteristics that is(are) present in the outermost layer, optionally present at side of the support where the light-sensitive emulsion layer(s) has(have) been coated. As non-ionic surfactant(s) having antistatic characteristics any of the generally known polyalkylene oxide polymers are useful as antistatic agent. Suitable examples of alkylene oxides are e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides.

In one embodiment the material of the present invention has as an outermost coating a protective antistress layer at the silver halide emulsion layer side or sides of the photographic silver halide emulsion layer material of the present invention, wherein said material is single-side or double side coated. In another embodiment the protective antistress layer is covered with a gelatin free antistatic afterlayer containing a conductive compound as required in at least one of the layers of the material according to the present invention. The coating of the said gelatin free antistatic layer, as well as the coating of the antistress layer may proceed by any coating technique known in the art, e.g. by doctor blade coating, air knife coating, curtain coating, slide hopper coating or meniscus coating, which are coating techniques known from the production of photographic silver emulsion layer materials. Moreover the spray coating technique, known from U.S. Pat. No. 4,218,533, may be applied. Any thickening agent may be used in order to regulate the viscosity of the solution used for any of the said coating techniques provided that they do not particularly affect the photographic characteristics of the silver halide light-sensitive photographic material. Preferred thickening agents include aqueous polymers such as polystyrene sulphonic acid, sulphuric acid esters, polysaccharides, polymers having a sulphonic acid group, a carboxylic acid group or a phosphoric acid group, polyacrylamide, polymethacrylic acid or its salt, copolymers from acrylamide and methacrylic acid and salts derived thereof, copolymers from 2-acrylamido-2-methyl-propansulphonic acid, polyvinyl alcohol, alginate, xanthane, carraghenan and the like. Polymeric thickeners well-known from the literature resulting in thickening of the coating solution may be used independently or in combination. Patents concerning thickening agents which can be used in the layers of the material acccording to the present invention are U.S. Pat No. 3,167,410, Belgian Patent No. 558 143, JP-A's 53-18687 and 58-36768, DE-A 38 36 945 and EP-A's 0 644 456 and 0 813 105. The gelatin-free antistatic afterlayer, if present as outermost layer of the material according to the present invention may further comprise spacing agents and coating aids such as wetting agents as e.g. :perfluorinated surfactants. Spacing agents which may also be present in the protective antistress layer in generally have an average particle size which is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708. Presence of at least one ionic or non-ionic polymer or copolymer latex in the protective antistress coating, and, optionally, in the afterlayer coated thereover, moreover provides the preservation of good antistatic properties of the material. Moreover the absence of water spot defects for the dry film after processing can be observed as has been described in EP-A's 0 644 454 and 0 644 456 as well as the appearance of an improved surface glare as has been described in the same EP-A's and in EP-A 0 806 705 and in EP-Application No. 98203412, filed Oct. 8, 1998. Even for thin coated layers for applications in rapid processing conditions the same advantages can be recognized. Furthermore the appearance of sludge in the processing is significantly reduced as well in hardener free as in hardener containing processing solutions.

Photographic silver halide emulsion materials according to the present invention are preferably used in radiography as the said materials as claimed hereinafter offer a solution for the problems as set forth in the background of the present invention. Single-side coated materials, as recording materials in mammographic applications (see e.g. EP-A's 0 610 609, 0 712 036, 0 874 275) in contact with an intensifying screen at the side of the film support having the light-sensitive emulsion layer(s) or in laser recording applications as e.g. described in EP-A 0 610 608 and 0 794 456 for the registration of digitally stored images, thus comprise a support and on one side thereof at least one silver halide emulsion layer and a protective gelatin antistress layer and, optionally, an outermost coating on the said side, whereas on the other side a backing layer is preferably present comprising e.g. one or more antihalation dyes which can be present either in the said outermost coating or in an underlying back coating or in both of them, thereby providing an improved image quality, especially sharpness. Antihalation dyes as mentioned are non-spectrally sensitizing dyes which are widely used in photographic elements to absorb reflected and scattered light. Examples of the said dyes have been described e.g. in U.S. Pat. Nos. 3,560,214 and 4,857,446 and in EP-A's 0 587 229 and 0 587 230. The filter or accutance dye(s) can be coated in layers of photographic elements in the form as has been described in EP-A's 0 384 633, 0 323 729, 0 274 723, 0 276 566, 0 351 593; in U.S. Pat. Nos. 4,900,653; 4,904,565; 4,949,654; 4,940,654; 4,948,717; 4,988,611 and 4,803,150; in Research Disclosure Item 19551 (July 1980); in EP-A 0 401 709 and in U.S. Pat. No. 2,527,583, these examples however being not limitative.

Double-side coated materials used in combination with intensifying screens in order to detect luminescent radiation generated from the phosphors absorbing X-rays as in medical X-ray applications or from direct X-rays as in non-destructive applications (see e.g. EP-A 0 890 875), wherein direct X-rays may be intensified and filtered by lead screens (see e.g. EP-A 0 603 431), thus comprise a support and on both sides thereof at least one silver halide emulsion layer and a protective gelatin antistress layer and, optionally, an outermost coating on the said both sides, wherein filter or accutance dyes mentioned hereinbefore can, in order to reduce cross-over as in the case of intensifying screen/film combinations, be present in the subbing layers, in a hydrophilic (gelatinous) layer between said subbing layers and a light-sensitive emulsion layer, in said emulsion layers (which may be coated as single emulsion layers or in two or more layers adjacent to each other) or even in the protective antistress layer or layers. Patents related therewith are EP-A's 0 592 724, 0 603 431, 0 678 772 and 0 790 526 and EP-Application No 98200061, filed Jan. 13, 1998.

Light-sensitive silver halide emulsions coated in one or more layers at both sides of the subbed support may be the same or different, which means that the same or differing silver halide emulsions may be coated wherein differences are related with differences in silver halide composition (as e.g. silver bromide, silver bromoiodide, silver chlorobromide, silver chlorobromoiodide, silver chloride, silver chloroiodide, silver chlorobromoiodide) and/or emulsion crystal habit (irregular or regular, being cubic, octahedral, {111} or {100} tabular, etc.), differences in mean crystal diameter, in monodispersity or heterodispersity of the emulsion distribution, differences in chemical sensitization and/or in spectral sensitization. In case of differences at both sides of the support, films are called "asymmetrical", whereas otherwise they are called "symmetrical". Also screens held in contact at both sides of the film material during exposure of the films with X-rays may be the same or different, wherein differences may be related with the presence of different phosphors, providing luminescent radiation of a different wavelength at differing sides of the film.

According to the present invention, a method is further provided for the formation of a diagnostic image comprising the step of exposing image-wise by laser irradiation a single-side coated material or exposing image-wise by X-ray irradiation a double-side coated material according to the present invention as described hereinbefore, said exposure step followed by processing said material by the steps of developing, fixing, rinsing and drying. A method for processing in a short total processing time of 60 seconds or less of forehardened materials with a developer comprising dihydroxybenzenes has e.g. been described in EP-A 0 731 382. Developers comprising ascorbic acids or derivatives thereof which are very suitable for use in the development method of the materials of the present invention have been described e.g. in EP-A 's 0 731 381, 0 731 382 and 0 732 619.

A method of processing suitable for processing materials of the present invention in a vertical processing apparatus, however not being limited thereto in the present invention, has been described in EP-Application No. 96201753, filed Jun. 24, 1996. Further processing methods have been disclosed extensively in EP-A's 0 851 282 and 0 851 286

(especially with respect to replenishment of the fixer solution), in EP-Application No. 97203096, filed Oct. 6, 1997 (with respect to fixation in a fixer containing hardening agents, with less sludge formation), in EP-Application No. 98200319, filed Feb. 3, 1998 (with respect to ecology, thereby leaving less silver in the rinsing water), in EP-Application No. 98201862, filed Jun. 5, 1998 (with respect to low replenishment amounts with low buffering capacity) and in EP-Application No. 98203412, filed Oct. 8, 1998 (with respect to excellent surface characteristics of the processed material, in processing solutions free from hardening agents and containing hardening agents as well).

By using a recording material having a composition according to the present invention problems as preservation of antistatic characteristics before processing, water spot defects, sticking and insufficient glare after processing in automatic processing machines can be avoided or substantially reduced. This means for example that the formation of static charges by contact of a silver halide emulsion layer side with the rear side of the recording material or caused by friction with substances such as rubber and hydrophobic polymeric binder, e.g. the binder constituent of phosphor screens used as X-ray intensifying screens, can be markedly reduced by employing the present antistatic layer in the layer arrangement of the film material according to the present invention. The building up of static charges and subsequent dust attraction and/or sparking, e.g. during loading of films in cassettes, e.g. X-ray cassettes, or in cameras, or during the taking or projection of a sequence of pictures as occurs in automatic cameras or film projectors is prevented.

The following examples illustrate the present invention without however limiting it thereto.

EXAMPLE

Preparation of Materials Nos. 1–3

PEDT Containing Subbed Support

On a web made of blue tinted longitudinally stretched polyethylene terephthalate having a thickness of approximately 610 μm was deposited, at both sides, following coating composition (given per liter of coating solution):

450 ml of demineralized water;

260 ml (30%, expressed as weight/volume unit) of a latex of ternary co-polymer being co(vinylidene chloride/methyl acrylate/itaconic acid) in a procentual weight ratio amount of 88/10/2;

91 ml (30%, expressed as weight/volume unit) of a latex of ternary co-polymer being co(butadiene/methyl acrylate/itaconic acid) in a procentual weight ratio amount of 47.5/47.5/5;

5 ml of concentrated ammonium hydroxide;

5.8 ml of an aqueous solution (50%, expressed as weight/volume unit) of melamine-formaldehyde derivative "Parez Resin 707"

5 ml of Kieselsol 100 F™, trademark product from Bayer AG, Leverkusen, Germany.

190 ml of a solution containing per liter of said solution
- 600 ml of demineralized water;
- 7.44 g of NaOH;
- 47.2 g of sulfosalicylic acid sodium salt;
- 260 ml ethanol
- 4.4 g of HOSTAPAL BV
- 40 g of floroglucin
- 7.76 g of AKYPO OP 80
- 32.8 g of sorbitol
- 40.8 g of 1,2-propanediol Said coating composition was applied on both sides of said support by air-knife coating, at a coverage of 130 sq.m./liter. The layer was dried in hot air stream whereafter the film was stretched transversally to 3.5 times its original width in a tenter frame in order to get a final film thickness of about 175 μm. The film was then heat-set while being kept under tension at a temperature of 190° C. for about 20 seconds. After heat-setting the film coated with this subbing layer at both sides thereof was cooled and further coated with following Compositions A, B and C as a first layer in contact with the subbed support layer for the Materials A, B and C respectively and Composition C as a second layer for the Materials A and B respectively (no second layer for Material C):

Composition A 500 ml of said coating composition A are containing:

447.5 ml of demineralized water;

5.8 ml of latex B (addition copolymer of vinylidene chloride, methylacrylate and itaconic acid, containing 88% by weight of vinylidene chloride units, 10% by weight of methylacrylate units, and 2% by weight of itaconic acid units was prepared as a latex by classical emulsion polymerisation conducted in aqueous medium in the presence of persulphate as initiator; concentration expressed as weight per volume unit: 30%).

43.8 ml of a dispersion of poly(3,4-ethylenedioxythiophene)/polyanion prepared before as follows:

Into 1000 ml of an aqueous solution of 20 g of polystyrene sulfonic acid (109 mmol of $SO_3H$ groups) with number-average molecular weight (Mn) 40,000, were introduced 12.9 g of potassium peroxidisulfate ($K_2S_2O_8$), 0.1 g of $Fe_2(SO_4)_3$ and 2.8 g of 3,4-ethylenedioxy-thiophene. The thus obtained reaction mixture was stirred for 24 h at 20° C. and subjected to desalting.

500 ml of the above prepared reaction mixture were diluted with 500 ml of water and stirred for 6 hours at room temperature in the presence of a granulated weak basic ion exchange resin LEWATIT H 600 (tradename of Bayer AG) and strongly acidic ion exchanger LEWATIT S 100 (tradename of Bayer AG. After said treatment the ion exchange resins were filtered off and the potassium ion and sulfate ion content were measured which were respectively 0.4 g $K^+$ and 0.1 g $(SO_4)^{2-}$ per liter.

1.25 ml of N-methylpyrrolidone;

1.7 ml UVON (=10% solution, expressed as weight per volume unit, of ULTRAVON W in a solution of demineralized water/ethanol 80/20). Coating composition A was coated at both sides of the subbed support described hereinbefore in an amount in order to coat 35 sq.m./liter as first layers of Material A coated upon the subbed support described hereinbefore.

Drying was performed during 1 minute at 120° C.

Composition B 500 ml of said coating composition B are containing:

482 ml of demineralized water;

5.8 ml of latex B (same as in composition A, given hereinbefore)

8.75 ml of a dispersion of poly(3,4-ethylenedioxythiophene)/polyanion prepared as given hereinbefore (composition A)

1.25 ml of N-methylpyrrolidone;

1.7 ml UVON (=10% solution, expressed as weight per volume unit, of ULTRAVON W in a solution of demineralized water/ethanol 80/20).

Coating composition B was coated at both sides of the subbed support described hereinbefore in an amount in order to coat 35 sq.m./liter as first layers of Material B coated upon the subbed support described hereinbefore. Drying was performed during 1 minute at 120° C.

Composition C 1000 ml of said coating composition C are containing:

978 ml of demineralized water;

5.7 g of gelatin Koepff K16353 (manufactured by Koepff, Heilbronn, Germany), 14.2 ml of Kieselsol 300 F (trademarked product from BAYER AG, Leverkusen, Germany)

0.15 ml of polymethyl methacrylate matting agent (diameter:2.5 μm; concentration 20%, expressed in weight ratio per volume unit);

10 ml of solution, the composition (per liter) of which is given hereinafter:

940 ml of demineralized water;

20 g of ULTRAVON W;

10 g of ARKOPAL N060;

33.3 g of hexylene glycol;

16.6 g trimethylol propane.

Coating composition C was coated at both sides of the subbed support described hereinbefore in an amount in order to coat 35 sq.m./liter as first layers of Material C coated upon the subbed support described hereinbefore.

As a second layer for Materials A and B, coated upon the first layers as indicated hereinbefore, composition C was coated. No second layer was coated for Material C.

Double side coated X-ray photographic materials Nos 1–3 were provided by subsequently coating at both sides on the Materials A, B and C a silver halide emulsion layer, a protective antistress layer and a gelatin free outermost afterlayer on top. Use was therefore made of the slide hopper coating technique for simultaneous application of the emulsion layer, the antistress layer and the outermost afterlayer at both sides of the coating Materials A, B and C, the composition of which has been given in the Table 1.

Preparation Method of the Photographic Material

A photographic material was prepared composed of a subbed polyester base (175 μm thick);

an emulsion layer comprising a mixture of two gelatinous silver halide emulsions (preparation described hereinafter) of which the silver halide consists for 99 mole % of silver bromide and 1 mole % of silver iodide having a ±111} tabular crystal habit;

a protective antistress layer having the composition given hereinafter.

an afterlayer as an outermost layer (in the examples where it applies)

The emulsion layer was containing a light-sensitive tabular silver bromoiodide emulsion, the preparation of which has been described hereinafter, starting from following solutions (held at 55° C.): solution 1: 1.96 molar of an aqueous silver nitrate solution. solution 2: 1.96 molar of an aqueous potassium bromide solution, solution 3: mixture containing 1.93 molar of an aqueous potassium bromide solution and 0.03 molar of an aqueous potassium iodide solution.

Following preparation steps were performed in order to precipitate the tabular emulsion crystals:

Nucleation Step 28 ml of solutions 1 and 2 were introduced into a reaction vessel in 28 seconds using the double jet technique. Said reaction vessel initially contained 2.127 liter of destined water at 45° C., 10.6 grams of potassium bromide and 6 grams of inert gelatin and was held at 55° C. After one minute the reaction temperature of this mixture was raised to 70° C. in 20 minutes and 47.5 grams of phthalated gelatin in 475 ml destilled water were added. After 10 minutes the neutralization step was started. During nucleation the stirring velocity in the reaction vessel was held at 150 rpm.

Neutralization Step 21.25 ml of solution 1 were added to the reaction vessel at a rate of 7.5 ml per minute to reach a UAg value (potential versus silver/silver chloride reference electrode) of +10 mV, whereafter the first growth step was started.

First Growth Step

A double jet precipitation was started using solutions 1 and 2: during 1 minute solution 1 was added at a flow rate of 7.5 ml per minute, while solution 2 was added at a rate of 7.7 ml/min., meanwhile maintaining the UAg value at +10 mV. The double jet precipitation continued for 31 min. 30 seconds at a flow rate while increasing the rate of solution 1 up to 22.2 ml per minute and solution 2 up to 22.6 ml per minute, meanwhile maintaining the UAg value at +10 mV again. Thereafter the second neutralization phase was started.

Second Neutralization Step 26.25 ml of solution 1 was added at a rate of 7.5 ml per minute in 3 min. 30 seconds so that a UAg value of +100 mV was obtained. The precipitation was then continued by a second growth step.

Second Growth Step

During 30 seconds solution 1 was injected in the reaction vessel at a flow rate of 7.5 ml per minute, while solution 3 was injected at the same flow rate. After increasing the stirring velocity up to 550 rpm during 30 seconds, the flow rates were increased during 41 minutes and 50 seconds up to 37.5 ml per minute, meanwhile maintaining a UAg value in the reaction vessel of +100 mV. The stirring velocity was decreased from 550 to 250 rpm.

The tabular grains of the emulsion thus obtained had the following characteristics, measured with electron microscopic techniques:

average equivalent circular diameter (ECD): 1.04 μm coefficient of variation of the tabular grains on ECD: 0.30 average thickness: 0.22 μm average aspect ratio: 4.8 percentage of total projective surface: 93%.

Washing and Dispersing Procedure

After the emulsion precitation was ended the pH value was lowered to 3.5 with diluted sulphuric acid and the emulsion was washed using demineralized water of 11° C. At 45° C. to the flocculate, having a volume of 1350 ml gelatin was added in order to have a gesi (ratio in grams of gelatin to silver) of 0.34 and demineralized water was added in order to have a total weight of 1923 grams. Values of pH and UAg at 40° C. were adjusted to 5.5 and +100 mV.

Sensitization

The dispersed emulsion was optimally sulphur, selenium and gold sensitized in the presence of sodium thiocyanate and anhydro-5,5'-dichloro-3,3'-bis(n.sulfobutyl)-9-ethyloxacarbocyanine hydroxide.

Stabilization and Preparation of the Emulsion Coating Solutions

The light-sensitive tabular grain emulsion was stabilized with 4-hydroxy-6-methyl-1,3,3a,7-tetra-azaindene and after addition of the normal coating additives the coating emulsion was coated simultaneously together with a protective antistress layer and an outermost afterlayer the compositions of which are given hereinafter:

The protective antistress layer was coated with the following compounds, expressed in grams per square meter per side:

| | |
|---|---|
| gelatin | 1.10 |
| polymethylmethacrylate (average particle diameter: 6 μm) | 0.023 |
| 1-p-carboxyphenyl-4,4'-dimethyl-3-pyrazolidine-1-one | 0.054 |
| $C_{17}H_{15}$—CO—NH—($CH_2$—$CH_2$—O—)$_{17}$—H | 0.0188 |
| formaldehyde | 0.1 |

The composition of said outermost afterlayer was as follows:

an ammoniumperfluorocarbonate compound represented by formula (IV)

$$F_{15}C_7COONH_4 \quad \text{(IV)}$$

a polyoxyethylene compound represented by the formula (V)

$$R—O—(CH_2CH_2O)_n—H \quad \text{(V)}$$

with n=10 and R=oleyl and a polymeric thickener represented by the formula (VI)

(VI)

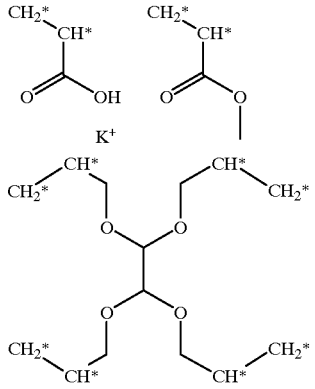

with a molar ratio of 3:18:79 for the distinct parts of the copolymer in the copolymeric latex. The three products were added to an aqueous solution containing up to 10% of ethyl alcohol with respect to the finished solution, ready for coating. Said three products were present in an amount of 0.75 g/l, 5.0 g/l and 6.5 g/l respectively and coated in an amount of 6.0 mg/m$^2$, 40.0 mg/m$^2$ and 52.0 mg/m$^2$ respectively. The amount of ethyl alcohol was evaporated during coating and drying. The resulting coated radiographic materials were the Matls. Nos. 1–3 in Table 2, coated on the respective subbed supports, coated with coatings A, B and C, respectively called Materials A,B and C hereinbefore.

Evaluation of the Material Samples Nos. 1–3

The resistance of the best conducting layer, the so-called "Q-mobile" value, was determined at 30% of relative humidity ("R.H.") at room temperature (21° C.), said value being practically independent upon relative humidity, and was expressed in Ohm/square. Following test procedure, described in Research Disclosure—June 1992, item 33840, was therefore applied in order to capacitively measure the resistance of the best conducting layer (layer having the lowest resistance) in a layer arrangement of a multilayered material: the resistance of the layer assemblage was measured contactless by arranging it between capacitor plates making part of a RC-circuit differentiator network. The dimensions of the measurement cell are chosen in such a way that relying on the known capacitor value (C) it is possible to calculate from the measured RC-value the electrical resistance of the layer assemblage. Such proceeds by connecting the equivalent serial circuit CR to a sine wave generator with output voltage $U_0$ and angular frequency ω. The voltage U over the resistor,when plotted versus ω, giving a cut-off frequency $\omega_0$ of the high-pass frequency filter of the first order (as the RC-circuit is considered to be) is reached at equal capacitance and resistivity so that $R=1/((\omega_0 \times C)$. When this condition has been fulfilled output voltage or source voltage $U_0$ is related to the voltage $U_R$ over the resistance taking into account a phase shift of 45° between the voltages so that $U_R=U_0 x\sin 45°$. If the sine wave generator frequency is adjusted at the value where $U_R=U_0 \times \sin 45°$ is met, wherein the amplitude or the phase shift or both can be measured, it is possible to determine the resistance by converting the formula $R=1/(\omega_0 \times C)$ into $R=1/(2 \times \pi \times f_0 \times C)$.

In case of a constant coupling capacitance C there is a fixed relation between the resistance and the measurable time constant τ wherein τ=R×C and thus also between said time constant τ and the cut-off frequency $f_0$. Starting from the formula RC=½πf and from the limitation of the sample frequency upon the used apparatus two differing experimental measuring arrangements are used in order to determine the "Q-mobile" value over two differing regions:

"$Q_{MOB1}$" measured over the region between $2 \times 10^7$ and $3 \times 10^{13}$ Ω/sq.; and "$Q_{MOB2}$" measured over the region between $3 \times 10^3$ and $3 \times 10^9$ Ω/sq.

The presence or absence of sparks in form of lines on the processed film appearing as a consequence of "line-discharges" was examined by following simulation procedure. The phenomenon of spark generation detected after processing in a processing machine occurs when an electrostatically loaded operator takes an exposed, unprocessed film material from a cassette, wherein it was in contact with intensifying screens comprising luminescent phosphors, whereafter an electrical discharge appears at the moment at which contact is made between the film material and the inlet of the said processing machine. Starting from the assumption that the operator was loaded electrostatically following electrical scheme (FIG. 1) is representative for the electrical discharge phenomena: an isolated and loaded operator is represented by a loaded capacitor plate having a capacity of 100 pF up to 300 pF (with an ability to load up to a voltage of some ten thousands of Volts). Contact was made between a plate A (see FIG. 1) of a capacitor (loaded up to a capacity of 300 pF) and a film material sample F without making contact with any other subject (by hanging up the film material sample F in an isolating frame FR). The other capacitor plate B, without making contact with the earth, was loaded up to −2 kV (corresponding with a discharge energy of about 2.4 mJoule). After having no charging current anymore contact with the source of high voltage was broken. In the capacitor, between plates A and B a dielectric medium DM was present.

The approach of the metal inlet of the "M6" processing machine, trademark product from the Eastman Kodak Co., USA, by a film material sample was simulated by a quick move to the film material sample F of a metal bar M having a relatively sharp edge (representing the inlet of the earthed processing machine) followed by making contact with the film to be processed. Time between loading said film material sample and contacting it with the metal bar was set to 10 seconds. This procedure was repeated four times for the same film material sample before processing it in the M6-processing machine (trademarked product from Eastman Kodak, USA), wherein as developer and fixer solutions G138® and G334®, both trademarked products from Agfa-Gevaert N.V., were used respectively in a total processing cycle of 90 seconds. Moreover the sensitivity to "spark-generation" for light-sensitive materials in case of tribo-electrical rubbing contact was determined by means of an apparatus (so-called "VONKOMAT" apparatus, wherein the material to be examined was brought into rubbing contact with a constant contacting force and with a constant velocity with two reference materials tribo-electrically far different from each other, like polyvinyl chloride (PVC) and polymethyl methacrylate (PMMA). By means of a so-called spark electrode the generated charge became discharged in a controlled way and the thus generated spark pattern was examined after processing. The presence of sparks, wherein the surface pattern was more important than the density thereof, was indicative for the "spark characterization" or "spark properties" of the material which was determined to a great extent by following factors, being chargeability, conductivity and sensitivity. Expressed in figures: "0" is indicative for the absence of spark generation, whereas a value of "3", "4" or "5" is indicative for an increasing sensitivity with respect to spark generation. The results are summarized in Table 2 hereinafter.

TABLE 2

"Q-mobile" resistance of the antistatic layer showing the best conductivity (lowest resistance); control of "appearance of sparks" and "spark characterization" in "VONKOMAT" versus PVC and PMMA for X-ray photographic Film Materials Nos. 1–3.

| Matl. No. | Q-mobile Ohm/square 30% R.H. | VONKOMAT vs · PVC | VONKOMAT vs · PMMA | Sparks |
|---|---|---|---|---|
| 1 (comp.) | $2.10 \times 10^{6}$ | 0 | 0 | YES |
| 2 (inv.) | $1.30 \times 10^{10}$ | 0 | 0 | NO |
| 3 (comp.) | $9.30 \times 10^{11}$ | 3.5 | 0 | NO |

The results as presented in the Table 2 are illustrative for the superior antistatic properties of the Material No. 2 according to the present invention with a layer composition having the desired resistance in the antistatic layer having the best conductivity (lowest resistance).

What is claimed is:

1. Silver halide photographic material comprising at one or both sides of a subbed support, corresponding with a single-side coated or a double-side coated material respectively, one or more layer(s) comprising a light-sensitive silver halide emulsion, one or more protective antistress layer(s) and, optionally, an outermost afterlayer, wherein at least one subbing layer(s) further comprises means in order to provide an electrical resistance, when conditioned at a relative humidity of at most 30%, measured as described in Research Disclosure June 1992, item 33840, of from $4\times10^{9}\Omega$/sq. up to $5\times10^{10}$ Ω/sq. for the layer having the lowest resistance, and wherein said means is a conductive compound being a metal oxide compound, wherein said metal is selected from the group consisting of tin, indium tin, vanadium, zinc, manganese, titan, indium, silicium, magnesium, barium, molybdene and tungsten.

2. Silver halide photographic material comprising at one or both sides of a subbed support, corresponding with a single-side coated or a double-side coated material respectively, one or more layer(s) comprising a light-sensitive silver halide emulsion, one or more protective antistress layer(s) and, optionally, an outermost afterlayer, wherein at least one subbing layer(s) further comprises means in order to provide an electrical resistance, when conditioned at a relative humidity of at most 30%, measured as described in Research Disclosure June 1992, item 33840, of from $4\times10^{9}$ Ω/sq. up to $5\times10^{10}$ Ω/sq. for the layer having the lowest resistance, and wherein said means is a conductive compound being a mixture of conductive compounds selected from the group of compounds consisting of a (co)polymer compound selected from the group consisting of a polymer with acidic groups optionally further crosslinked by aziridines; a mixture of water-soluble conductive polymers, containing sulphonic acid groups, sulphuric acid groups or carboxylic acid groups together with a hydrophobic polymer and a crosslinking or curing agent, a (poly)phosphazene, a graft polymer of polyphosphazenes with polyalkylene glycols; (co)polymers of a diallyldialkylammonium salt; polyalkyleneimine grafted vinyl polymers; a copolymer of styrene sulphonic acid and a hydroxyl group containing monomer crosslinked by methoxyalkylmelamine; the said copolymer of styrene sulphonic acid but crosslinked by a hydrolyzed metal lower alkoxide; polymer complexes containing polyalkylene oxide units; a combination of polymerized oxyalkylene units and a fluorine containing inorganic salt; a polyoxyalkylene in combination with a thiocyanate, iodide, perchlorate, or periodate; a highly crosslinked vinylbenzyl quaternary ammonium polymer in combination with a hydrophobic binder; a sulphonated anionic microgel latex, polymers and copolymers of pyrrole, furan, aniline, vinyl-carbazole and pyridine and their derivatives, a tetracyano-quinone (TCNQ) complex and polyarenemethylidenes and derivatives thereof and a metal oxide compound, said metal being selected from the group consisting of tin, indium tin, vanadium, zinc, manganese, titan, indium, silicium, magnesium, barium, molybdene and tungsten.

3. Silver halide photographic material comprising at one or both sides of a subbed support, corresponding with a single-side coated or a double-side coated material respectively, one or more layer(s) comprising a light-sensitive silver halide emulsion, one or more protective antistress layer(s) and, optionally, an outermost afterlayer, wherein at least one subbing layer(s) further comprises means in order to provide an electrical resistance, when conditioned at a relative humidity of at most 30%, measured as described in Research Disclosure June 1992, item 33840, of from $4\times10^{9}$ Ω/sq. up to $5\times10^{10}$ Ω/sq. for the layer having the lowest resistance, and wherein said means is a conductive compound being a polythiophene compound, incorporated in said antistatic layer(s), in said afterlayer(s) and/or in said subbing layer(s) as an aqueous dispersion of a polythiophene compound/polymeric anion complex.

4. Material according to claim 1, 2, or 3, wherein said electrical resistance is from $1\times10^{10}$ Ω/sq. up to $5\times10^{10}$ Ω/sq.

5. Material according to claim 1, 2, or 3, wherein said electrical resistance is from $1\times10^{10}\Omega$/sq. up to $2\times10^{10}$ Ω/sq.

6. Material according to claim 3, wherein said polythiophene compound is poly(3,4-ethylenedioxy-thiophene) (PEDT).

* * * * *